US005818494A

United States Patent [19]

Sato

[11] Patent Number: 5,818,494

[45] Date of Patent: Oct. 6, 1998

[54] COLOR THERMAL PRINTER

[75] Inventor: Masamichi Sato, Saitama, Japan

[73] Assignee: Fuji Photo Film Co., Ltd., Kanagawa, Japan

[21] Appl. No.: 493,532

[22] Filed: Jun. 22, 1995

[30] Foreign Application Priority Data

Jun. 22, 1994 [JP] Japan ..... 6-140185

[51] Int. Cl.[6] ..... B41J 2/325; B41J 25/304

[52] U.S. Cl. ..... 347/173; 347/197

[58] Field of Search ..... 347/172, 173, 347/175, 197, 198; 400/120.03, 120.02, 120.16, 120.17

[56] References Cited

U.S. PATENT DOCUMENTS 5,101,222 3/1992 Hakkaku ..... 347/175

5,176,459 1/1993 Bessho et al. ..... 347/198

*Primary Examiner*—Huan H. Tran

*Attorney, Agent, or Firm*—Sughrue, Mion, Zinn, Macpeak & Seas, PLLC

[57] ABSTRACT

A color thermal printer has three thermal heads disposed along a transport path of a thermosensitive recording sheet. Each of the thermal heads are supported in movable fashion between an advanced position where the thermal heads are pressed against the recording sheet, and a retracted position away from the recording sheet. An advancing period is predetermined to precede a time point when each thermal head starts being driven. The thermal heads are serially moved to the advanced position, from the retracted position slowly during the predetermined advancing period, gradually to raise the pressing force of the thermal heads to the recording sheet. A full-color image is thermally recorded to the recording sheet by the thermal heads in the advanced position while the recording sheet is transported in one direction.

24 Claims, 8 Drawing Sheets

COLOR THERMAL PRINTER

BACKGROUND OF THE INVENTION

1. Field of the Invention

The present invention relates to a color thermal printer. More particularly, the present invention relates to a color thermal printer which has plural thermal heads and records a full-color image on to a recording material while transported in one fixed direction.

2. Description Related to the Prior Art

There are various color thermal printers, of which examples are direct thermal printing type and a thermal transfer printing type. Any of the types incorporates a thermal head in which a great number of heating elements are arranged in line. A thermosensitive recording sheet for use in the direct thermal printing type includes cyan, magenta and yellow coloring layers formed on a support in the order listed. A thermal head is driven for recording to each of the recording layers, to produce a full-color image on the recording sheet. In the thermal transfer type, a color ink sheet of a great length is used, in which yellow, magenta and cyan ink areas are formed in cyclic fashion. The ink or dye is thermally transferred to a recording sheet, to produce a full-color image.

There are plural types of color thermal printers: a three-pass one-head type which has one thermal head and in which a recording sheet is passed three times under the thermal head; and a one-pass three-head type which has three thermal heads and in which a recording sheet is passed one time under the thermal heads. The one-pass three-head type requires a greater number of parts than the three-pass one-head type, but has advantages in shorter time required for printing the same image, because the recording sheet is passed only one time.

FIG. 8 illustrates a color thermal printer of the one-pass three-head type. Three platen rollers 2–4 are disposed along a straight transport path. Above the platen roller 2 is a yellow recording thermal head 6. Above the platen roller 3 is a magenta recording thermal head 7. Above the platen roller 4 is a cyan recording thermal head 8. The thermal heads 6–8 are moved between an upper retracted position and a lower advanced position by solenoids 9–11. In the retracted position, the thermal heads 6–8 are moved up and away from the recording sheet 5. In the advanced position, the thermal heads 6–8 are moved to press the recording sheet 5. The solenoids 9–11 are controlled by a controller 12.

The recording sheet 5 is transported in the rightmost arrow direction indicated in FIG. 8. When a leading edge of a recording area comes to the yellow recording head 6, the yellow recording head 6 is moved by the solenoid 9 to the advanced position for the recording, and records a yellow image to the yellow thermosensitive recording layer. Then the yellow recording layer is fixed by a yellow layer fixing device 13. When the leading edge of the recording area comes to the magenta recording head 7, the magenta recording head 7 is moved to the advanced position, and records a magenta image to the magenta thermosensitive recording layer. The magenta recording layer is fixed by a magenta layer fixing device 14. Likewise the cyan recording head 8 records a cyan image to the cyan thermosensitive recording layer. The recording to the recording sheet 5 is finished. The recording sheet 5 is exited to a receptacle tray.

In the one-pass three-head type, a magenta image is recorded later than a yellow image. During the recording of the yellow image to the yellow recording layer, the magenta recording head 7 comes in contact with, and presses, the recording sheet 5. The thermal heads 6–8 are moved abruptly or instantaneously moved by the solenoids 9–11 from the retracted position to the advanced position. The recording sheet 5 quickly receives the pressing force from the magenta recording head 7, so that there is a considerable change in load to the recording sheet 5, and to the platen rollers 2–4, of which surfaces are distorted and rotational axes are twisted to a greater extent. If a stepping motor is used as a power source for transportation of the recording sheet 5, the platen rollers 2–4 are stopped after stepwise rotation in positions deviated from regularly determined positions, because the magnetic force and the load in transportation are balanced in an unwanted fashion. This is a problem, even though the rotor of the motor is not stepped out. The transporting speed of the recording sheet 5 is changed temporarily according to the changes in the distortion of the transport system. There occurs a stripe 15 of irregularly higher or lower optical density (see FIG. 9).

The yellow recording layer is heated first for the recording, and finishes being heated first. The yellow recording head 6 is moved back to the retracted position upon the finish of the recording. The load of the yellow recording head 6 to the recording sheet 5 abruptly comes down to zero. Since the change in the load also results in change in the speed of transporting the recording sheet 5, an optical density change in stripes takes place in portions where the magenta and cyan recording heads 7 and 8 press the recording sheet 5.

SUMMARY OF THE INVENTION

In view of the foregoing problems, an object of the present invention is to provide a color thermal printer capable of avoiding the occurrence of stripes of irregularly higher or lower optical density even with the thermal heads are moved to or away from the recording material.

In order to achieve the above and other objects and advantages of this invention, a color thermal printer is provided wherein plural head moving devices respectively associated with the thermal heads in movable fashion between an advanced position where the thermal heads are pressed against the recording material, and a retracted position substantially away from the recording material, are provided for moving the thermal heads from the retracted position to the advanced position slowly during a predetermined advancing period, gradually to raise, pressing force of the thermal heads to the recording material.

After the thermal heads are driven in the advanced position, the plural head moving devices move the thermal heads from the advanced position to the retracted position slowly during a predetermined retracting period, to gradually lower the pressing force of the thermal heads to the recording material.

BRIEF DESCRIPTION OF THE DRAWINGS

The above objects and advantages of the present invention will become more apparent from the following detailed description when read in connection with the accompanying drawings, in which.

DETAILED DESCRIPTION OF THE PREFERRED EMBODIMENT(S) OF THE PRESENT INVENTION

Figure 1:
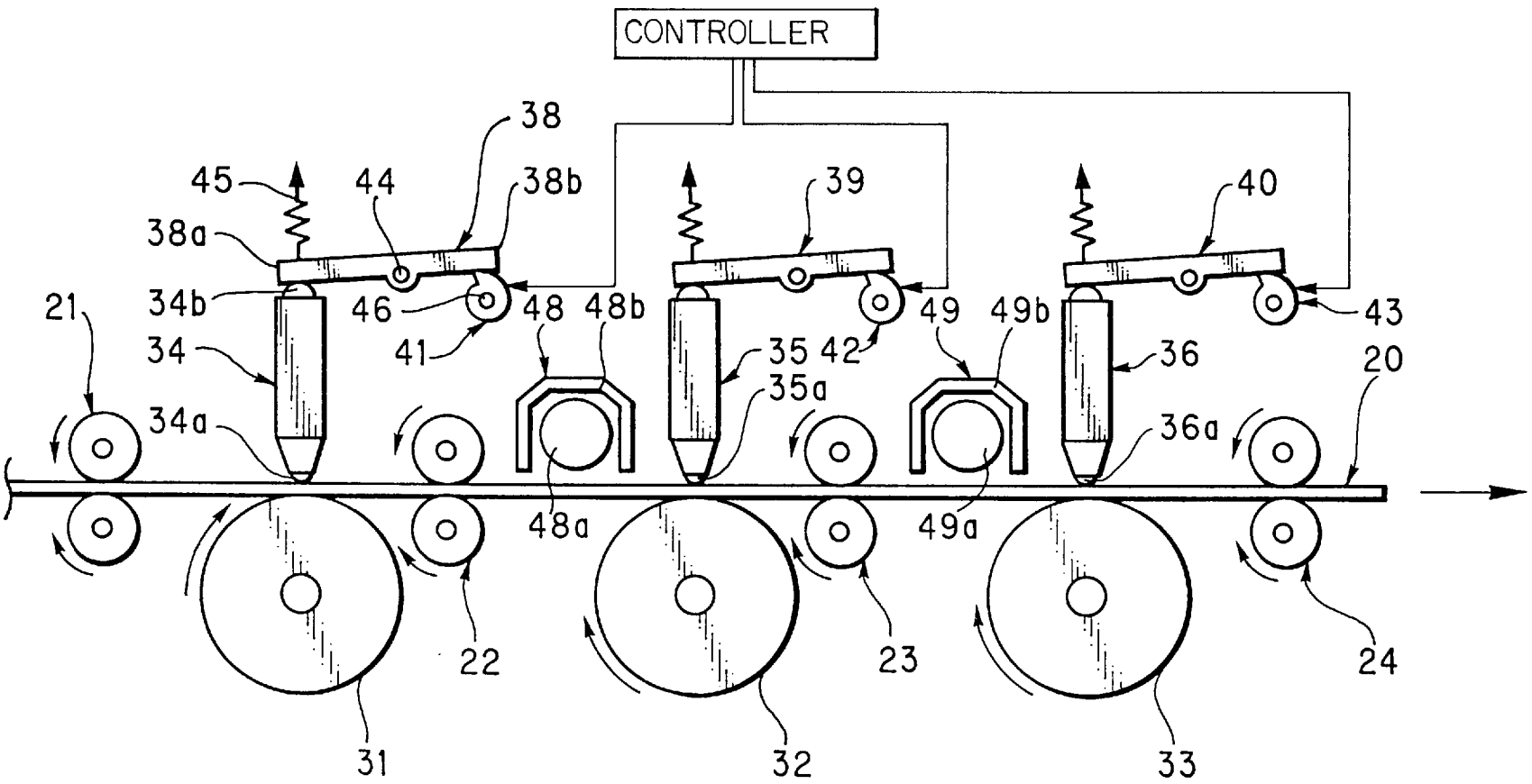
FIG. 1 is an explanatory view in elevation, schematically illustrating a color thermal printer of a one-pass three-head type.

In FIG. 1, a color thermal printer has pairs of transport rollers 21, 22, 23 and 24 arranged at a regular interval to form a straight path for transporting a color thermosensitive recording sheet 20. The recording sheet 20 is transported toward the right as viewed in FIG. 1 at constant speed.

Figure 2:
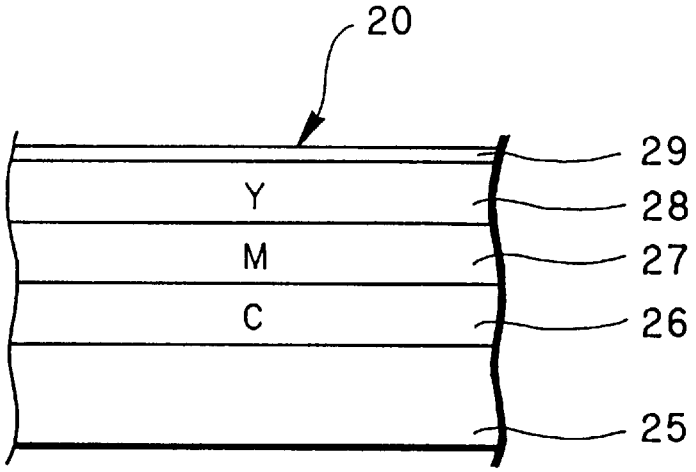
FIG. 2 is an explanatory view illustrating a layered structure of a color thermosensitive recording sheet.

In FIG. 2 illustrating a layered structure of the recording sheet 20, there are a cyan coloring layer 26, a magenta coloring layer 27, a yellow coloring layer 28, and a protective layer 29, which are formed on a support 25 in the order listed. The order of the recording to the coloring layers 26–28 is "yellow-magenta-cyan" from the obverse toward the reverse, namely from the protective layer 29 toward the support 25. If an alternative recording sheet for use with the printer has a structure as if the yellow coloring layer 28 and the magenta coloring layer 27 were interchanged, then its recording order is "magenta-yellow-cyan". The cyan coloring layer 26, the closest to the support 25 of the three, has a characteristic color in response to the highest heat energy. The yellow coloring layer 28, the farthest from the support 25 of the three, has a characteristic color in response to the lowest heat energy. It is possible to develop colors of the coloring layers 26–28 selectively by changing heat energy applied to the recording sheet 20.

As illustrated in FIG. 1, there are three platen rollers 31, 32 and 33 arranged between the pairs of the transport rollers 21–24. The recording sheet 20 is transported on the platen rollers 31–33. Above the platen roller 31 is a yellow recording thermal head 34. Above the platen roller 32 is a magenta recording thermal head 35. Above the platen roller 33 is a cyan recording thermal head 36. Namely the thermal heads 34–36 are arranged in the order following the transportation of the recording sheet 20. Each of the thermal heads 34–36 has an upright structure and is movable up and down. Bottoms of the thermal heads 34–36 have respectively arrays 34*a*–36*a* of linearly arranged plural heating elements. The heating element arrays 34*a*–36*a* are extended crosswise to the direction of transporting the recording sheet 20. Each of the thermal heads 34–36 is incessantly biased by a head lifting spring 37 upward, namely away from the recording sheet 20 toward a retracted position.

Above the thermal heads 34–36, there are transmission levers 38–40 and cams 41–43 which are head moving devices respectively associated with the thermal heads 34–36. For the yellow recording head 34, the lever 38 is supported in rotatable fashion about a shaft 44. A distal end 38*a* of the lever 38 is contacted on a top 34*b* of the yellow recording head 34. Another distal end 38*b* is contacted on the cam 41. A spring 45 is secured to the distal end 38*a* for biasing the lever 38 in the clockwise direction. The spring 45 incessantly keeps the distal end 38*b* in contact with the cam 41. The cam 41 is supported in rotatable fashion about a shaft 46, and is so shaped that its radius about the shaft 46 is gradually increased. The cam 41 is rotated by a motor (not shown).

Figure 3:
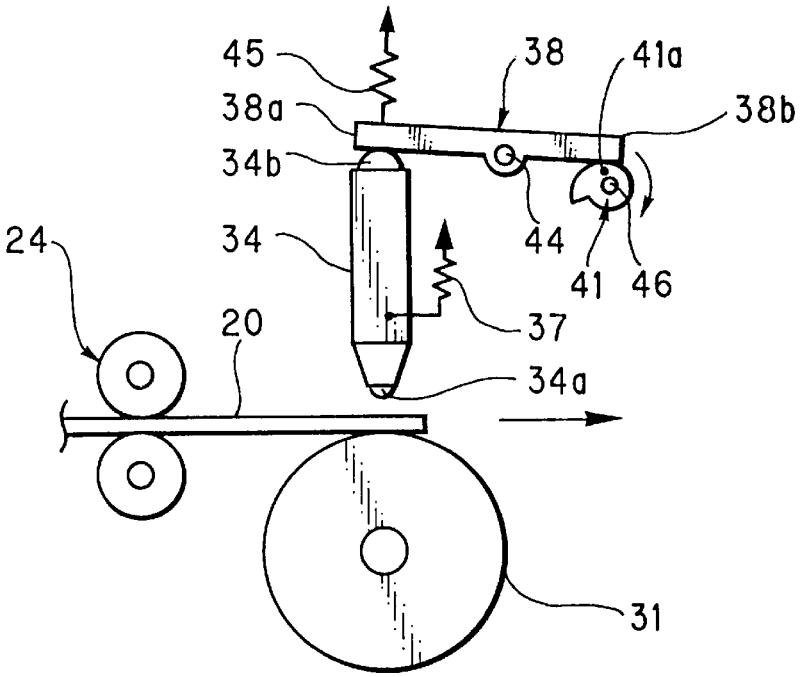
FIG. 3 is an explanatory view in elevation, illustrating a thermal head in its retracted position.

When a smaller radius portion 41*a* of the cam 41 is contacted on the lever 38 as illustrated in FIG. 3, the lever 38 stands swung by the bias of the spring 45 in the clockwise direction. The yellow recording head 34 is biased by the head lifting spring 37 and oriented to have an upper retracted position to contact on the lever 38. In the retracted position, the yellow recording head 34 applies no pressure to the recording sheet 20 and is standing by for a recording operation. A distance of the retraction of the yellow recording head 34 may be small. It is possible to define the retracted position where the yellow recording head 34 is lightly contacted on the recording sheet 20 without pressure, that is, "substantially away" from the recording sheet 20.

Figure 4:
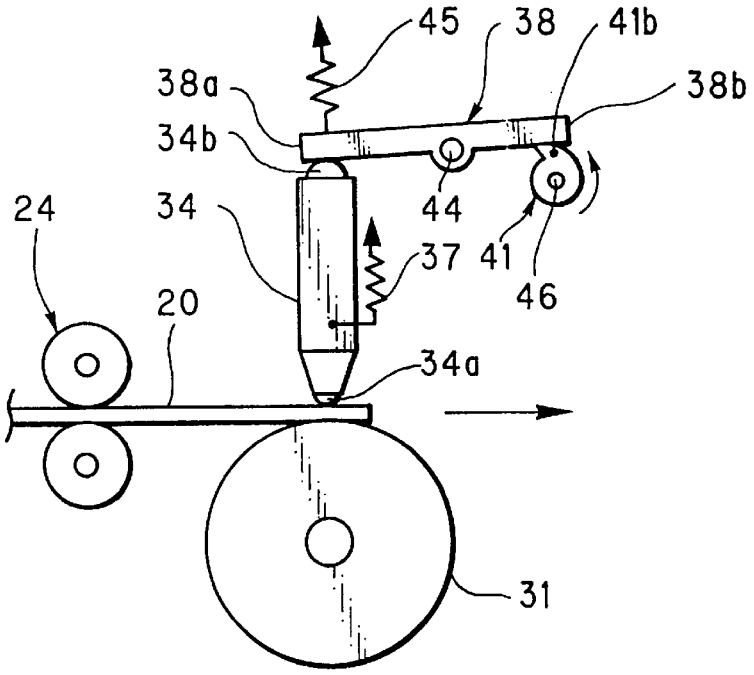
FIG. 4 is an explanatory view in elevation, illustrating a thermal head in its advanced position.

When the cam 41 makes substantially one fourth of a rotation in the clockwise direction, a larger radius portion 41*b* of the cam 41 is contacted on the lever 38 as illustrated in FIG. 4. In this position, the lever 38 stands swung counterclockwise against the bias of the spring 45. The distal end 38*a* of the lever 38 depresses the yellow recording head 34 to the lower advanced position against the bias of the head lifting spring 37. The heating element array 34*a* of the yellow recording head 34 is contacted on the recording sheet 20, at first lightly, and then with gradually greater force as the cam 41 rotates.

Figure 5:
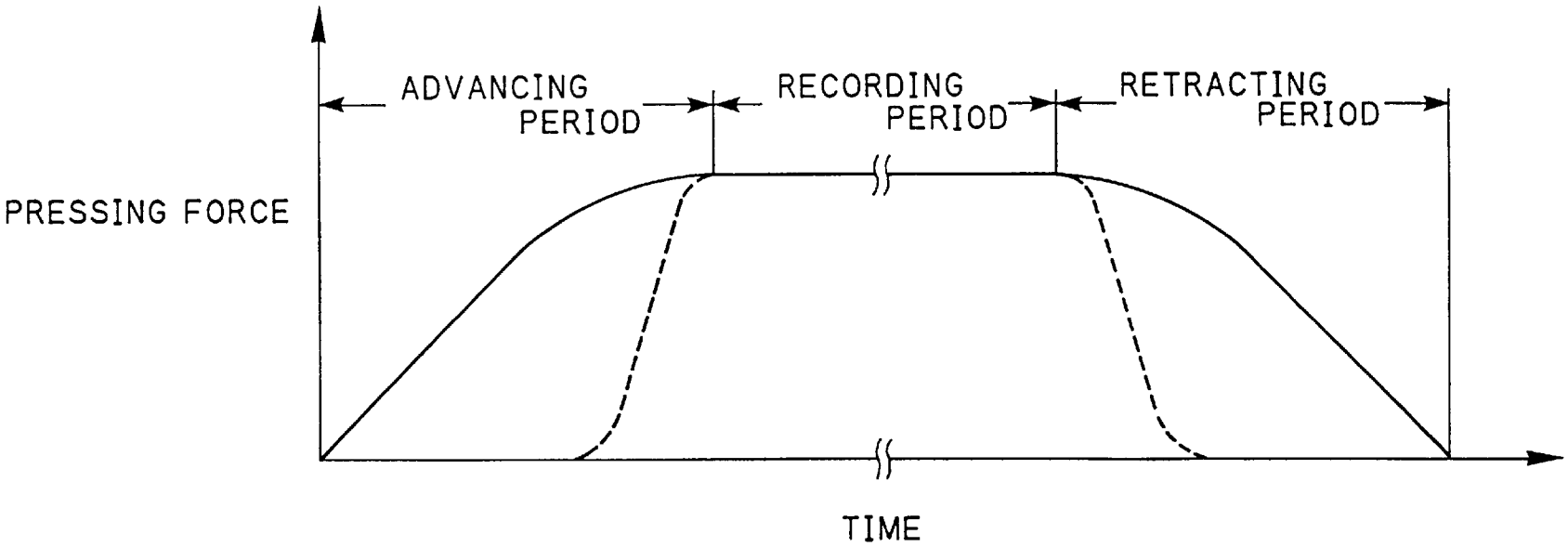
FIG. 5 is a graph illustrating pressing force of the thermal head to the recording sheet.

In FIG. 5 illustrating the pressing force of the thermal head to the recording sheet, the device for moving a head is constituted by the cam with the lever. As indicated by the solid lines, the head moving device moves the thermal head to the advanced position with gradually increasing force of pressure. The broken lines indicate movement of the thermal head according to the prior art by way of a solenoid. Evidently, the thermal head is moved with abruptly increasing force. When the cam 41 is rotated counterclockwise from the state of FIG. 4, the yellow recording head 34 is released from being pressed by the lever 38, and moved up by the head lifting spring 37 to the retracted position. As illustrated in FIG. 5, the pressing force of the yellow recording head 34 gradually decreases, while the yellow recording head 34 is being released from pressing the recording sheet 20.

As illustrated in FIG. 1, a yellow layer fixing device 48 is disposed between the yellow recording head 34 and the magenta recording head 35. Between the magenta recording head 35 and the cyan recording head 36 is disposed a magenta layer fixing device 49. The yellow layer fixing device 48 includes an ultraviolet lamp 48*a* emitting rays peaking at the wavelength of approximately 420 nm, and a lamp housing 48*b* containing the ultraviolet lamp 48*a*. The magenta layer fixing device 49 includes an ultraviolet lamp 49*a* emitting rays peaking at the wavelength of approximately 365 nm, and a lamp housing 49*b* containing the ultraviolet lamp 49*a*.

Operation of the above embodiment is described now. As illustrated in FIG. 1, a leading edge of a recording area on the recording sheet 20 is moved to the yellow recording head 34 by the transport rollers 21. The cam 41 is rotated clock-wise about the shaft 46. The larger radius portion 41*b* of the cam 41 is contacted on the distal end 38*b* of the lever 38, which is rotated counterclockwise about the shaft 44 against the bias of the spring 45. The distal end 38*a* depresses the top 34*b* of the yellow recording head 34 against the bias of the head lifting spring 37 and to the advanced position. The pressing force of the heating element array 34*a* to the recording sheet 20 gradually increases as illustrated in FIG. 5 in the course of contacting the recording sheet 20.

The heating element array 34*a* of the yellow recording head 34 generates heat in a range adapted to the heat sensitivity of the yellow coloring layer 28, to thermally record a yellow image line after line. When an image portion of the yellow coloring layer 28 comes to the yellow layer fixing device 48, the ultraviolet lamp 48*a* applies near ultraviolet rays of about 420 nm to the recording sheet 20. The yellow coloring layer 28 is fixed to such a degree that it will never be colored any further even when the magenta coloring layer 27 is colored.

The leading edge of the recording area on the recording sheet 20 is moved to the magenta recording head 35. The cam 42 causes the lever 39 to rotate counterclockwise, to depress the magenta recording head 35, in a manner similar to the yellow recording head 34. The pressing force to the recording sheet 20 gradually increases as illustrated in FIG. 5. The magenta recording head 35 is so slowly pressed against the recording sheet 20 that no abrupt change takes place in the load to the recording sheet 20 while transported, and that there is no influence to the transporting speed. The yellow recording head 34 is prevented from creating irregularities in optical density in a striped shape.

The heating element array 35*a* of the magenta recording head 35 generates heat in a range adapted to the heat sensitivity of the magenta coloring layer 27, thermally to record a magenta image line after line. When an image portion of the magenta coloring layer 27 comes to the magenta layer fixing device 49, the ultraviolet lamp 49 a applies near ultraviolet rays of about 365 nm to the recording sheet 20. The magenta coloring layer 27 is fixed to such a degree that it will never be colored any further even when the cyan coloring layer 26 is colored.

The leading edge of the recording area on the recording sheet 20 is moved to the cyan recording head 36. The cam 43 causes the lever 40 to rotate counterclockwise, to depress the cyan recording head 36, in a manner similar to the yellow recording head 34 and the magenta recording head 35. The pressing force to the recording sheet 20 gradually increases as illustrated in FIG. 5. The magenta recording head 35 is so slowly pressed against the recording sheet 20 that no abrupt change takes place in the load to the recording sheet 20 while transported, and that there is no influence to the transporting speed. The yellow recording head 34 and the magenta recording head 35 are prevented from creating irregularities in optical density in a striped shape.

The heating element array 36*a* of the cyan recording head 36 generates heat in a range adapted to heat sensitivity of the cyan coloring layer 26, thermally to the record a cyan image line after line. Note that the cyan coloring layer 26 has no characteristic of photochemical fixability. Possibility in accidental coloring of the cyan color layer 26 is negligible, as the critical heat energy for coloring the cyan coloring layer 26 is determined beyond a level of possible energy occurring in an ordinary state of preservation of the recording sheet 20.

Before the ends of recording to the magenta coloring layer 27 and the cyan coloring layer 26, all the yellow image finishes being recorded to the yellow coloring layer 28. The yellow recording head 34 moves to the retracted position. The cam 41 is rotated counterclockwise from the position of FIG. 4. The lever 38 is rotated in the clockwise direction by the bias of the spring 45. The yellow recording head 34 is slowly released from being pressed by the lever 38. As illustrated in FIG. 5, the heating element array 34*a* of the yellow recording head 34, having contacted the recording sheet 20 with weight, comes to have gradually smaller force in contact with the recording sheet 20, until it comes away from the recording sheet 20. No abrupt change takes place in the load of the yellow recording head 34 to the recording sheet 20 while transported, and that there is no influence to the transporting speed. It is possible to prevent the magenta recording head 35 and the cyan recording head 36 from creating irregularities in optical density in a striped shape.

The thermal recording to the magenta coloring layer 27 is terminated. The ultraviolet lamp 48*a* of the yellow layer fixing device 48 is turned off at the same time. In the same manner as the yellow recording head 34, the magenta recording head 35 leaves the recording sheet 20 with gradually decreasing force of pressure to the recording sheet 20 by the virtue of the head lifting spring and the cam 42, as illustrated in FIG. 5. The magenta recording head 35 is so slowly released from pressing the recording sheet 20 that no abrupt change takes place in the load to the recording sheet 20 while transported, and that there is no influence to the transporting speed. It is possible to prevent the cyan recording head 36 from creating irregularities in optical density in a striped shape.

The thermal recording to the cyan coloring layer 26 is terminated. The ultraviolet lamp 49*a* of the magenta layer fixing device 49 is turned off. The cyan recording head 36 is retracted from the recording sheet 20, which is exited to a receptacle tray by the transport rollers 24.

Figure 6:
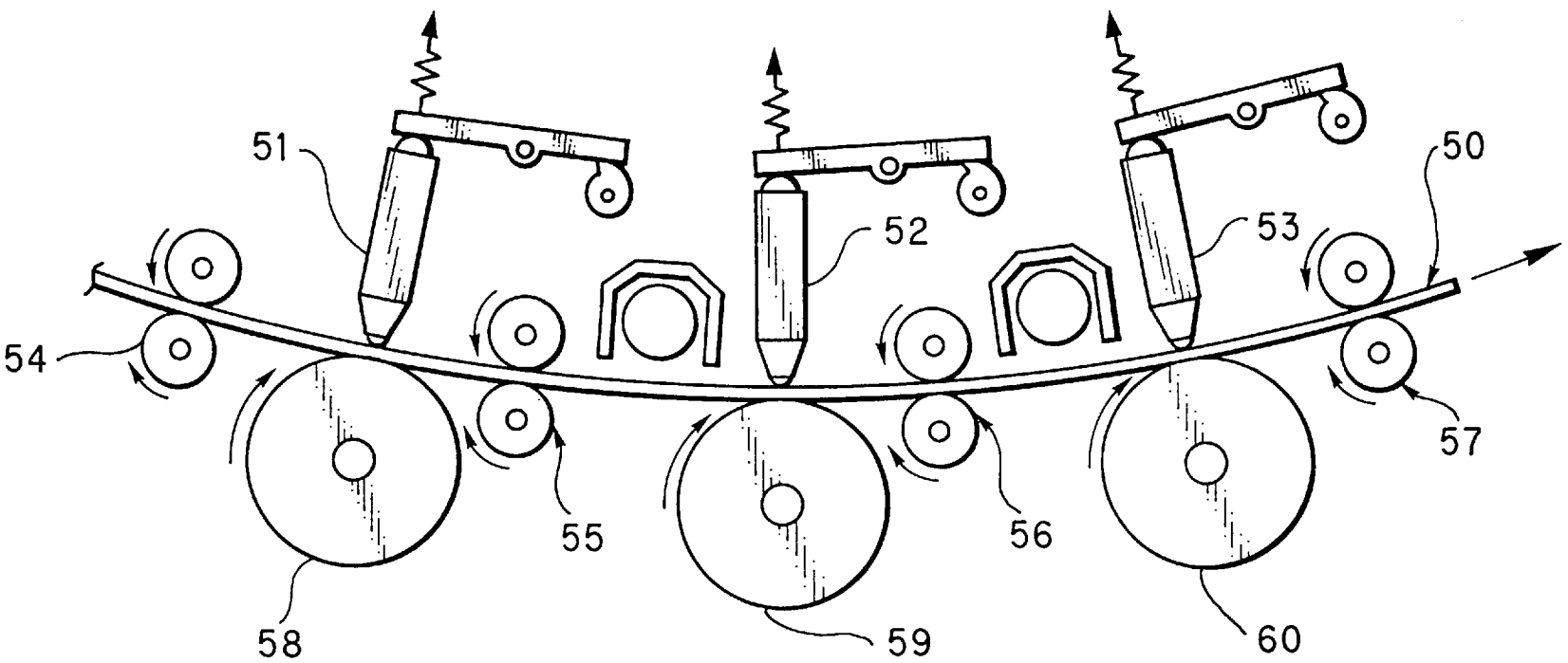
FIG. 6 is an explanatory view in elevation, schematically illustrating another preferred printer in which the transport path is curved.

The head moving device including the lever and the cam is also usable in another preferred printer of FIG. 6, in which a transport path for a recording sheet 50 is curved. It is possible to avoid occurrence of irregularities in advancement and retraction of thermal heads 51, 52 and 53. Along the transport path are arranged plural pairs of transport rollers 54, 55, 56 and 57 and platen rollers 58, 59 and 60 disposed between the transport rollers 54–57 at regular intervals. The curved transport path has advantages in reducing the size of the color thermal printer, because the size can be shortened in the horizontal direction along the length of the recording sheet 50, nearly without heightening the printer the over the height of the former printer of FIG. 1 with the straight path of transportation.

Figure 7:
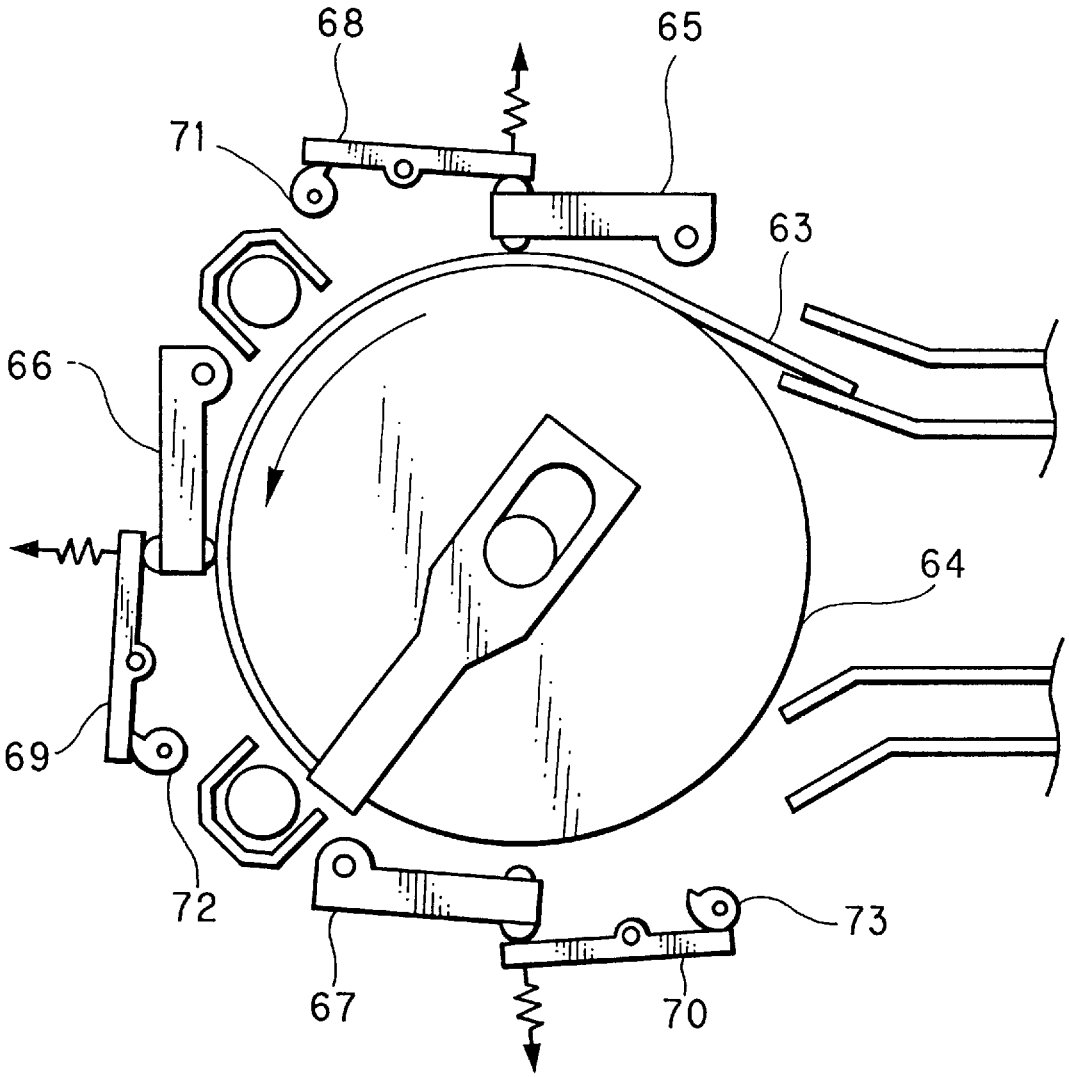
FIG. 7 is an explanatory view in elevation, schematically illustrating still another preferred printer in which the transport path is along a platen drum.
Figure 8:
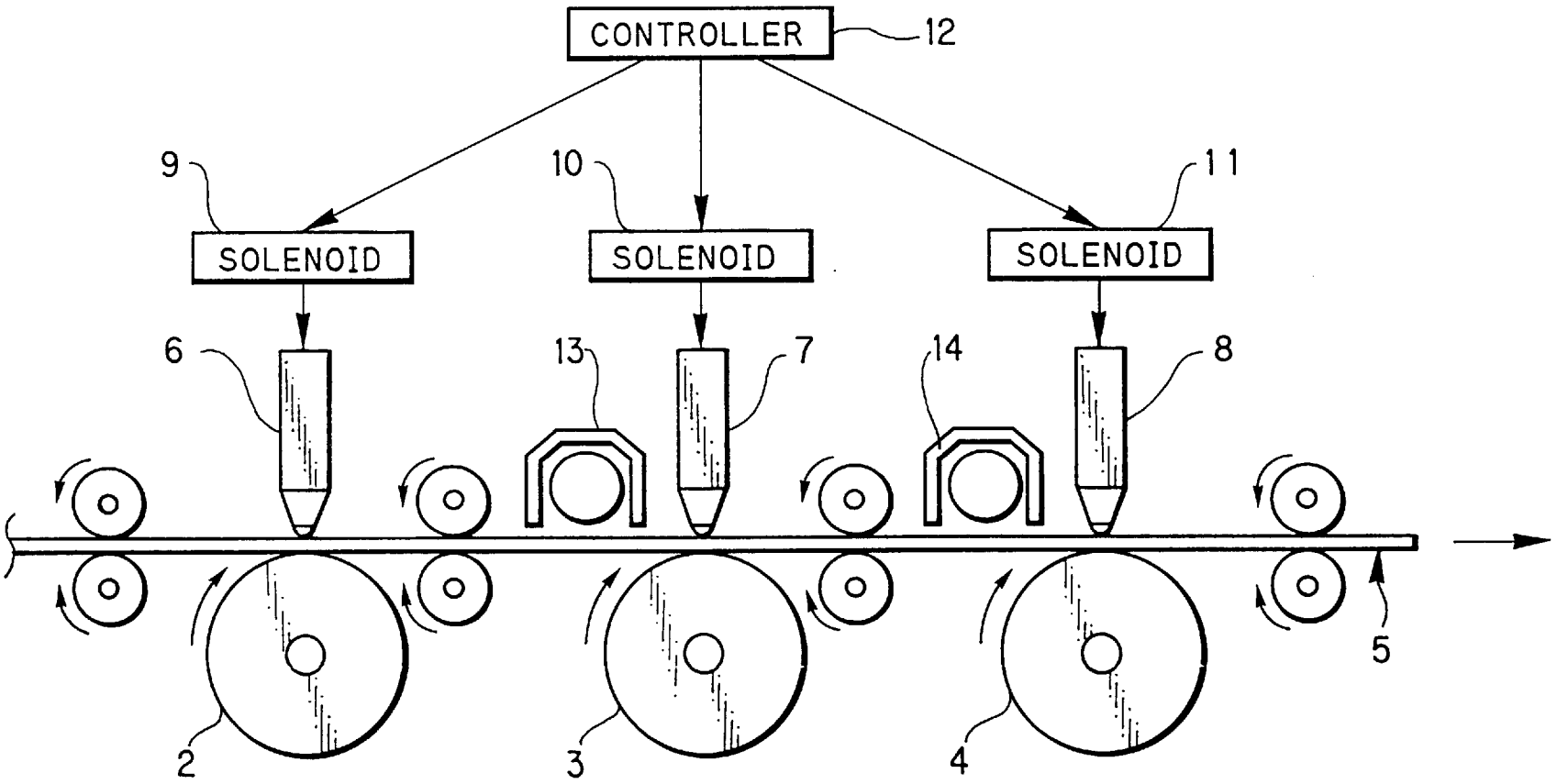
FIG. 8 (PRIOR ART)
FIG. 8 is an explanatory view in elevation, schematically illustrating a conventional printer including solenoids for thermal heads.
Figure 9:
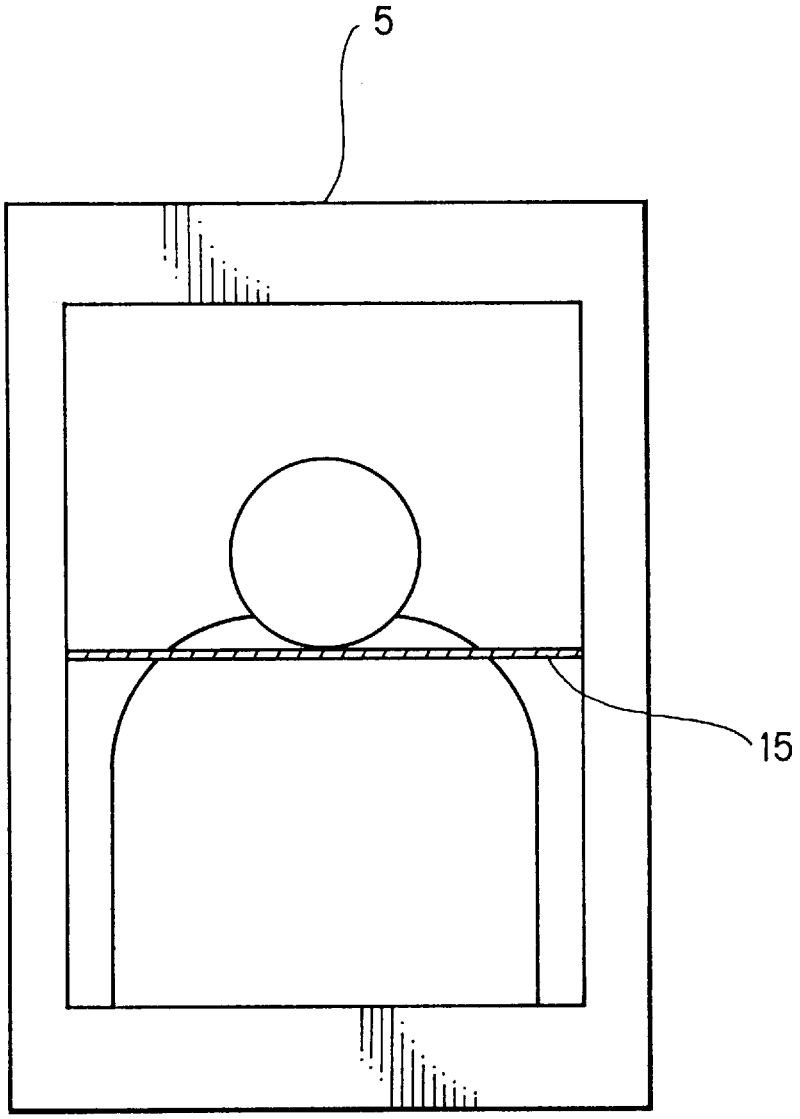
FIG. 9 (PRIOR ART)
FIG. 9 is an explanatory view illustrating occurrence of a stripe with irregularly higher or lower optical density.

Similar construction is also usable in still another preferred printer of FIG. 7, in which a transport path for a recording sheet 63 is circular. It is possible to avoid occurrence of irregularities in advancement and retraction of thermal heads 65–67. The printer has a platen drum 64 of a large diameter, of which the recording sheet 63 is supported on the periphery. The platen drum 64 is rotated counterclockwise. Around the platen drum 64 are arranged the thermal heads 65–67, which are advanced toward the center of the platen drum 64. Beside the thermal heads 65–67, there are levers 68–70 and cams 71–73 which are head moving devices respectively associated with the thermal heads 65–67. Note that the printer with the rotary structure is effective in reducing its cost and size with a reduced number of parts, because the single platen drum operates for the plural transport rollers and the plural platen rollers included in the former printers of FIGS. 1 and 6.

The printers related to the above embodiments are color thermal line printers of a color direct recording type. The present invention is also applicable to a thermal transfer type of color thermal printer in which an ink sheet is used. In the embodiments, thermosensitive recording sheets of a limited length are used in the printer. The invention is also applicable to a thermal printer in which a continuous thermosensitive recording sheet is used for printing. Such a continuous sheet can be cut into sheets after the printing. In the above embodiments, the head moving devices include a lever. Alternatively head moving devices may have a cam mechanism which may be directly linked with a thermal head without a lever. Further, head moving devices may consist of a slidable type of cam mechanism, instead of the rotary type. Furthermore, head moving devices may have a lever and a solenoid for driving the lever.

In the above, all the thermal heads are moved slowly to press the recording sheet 5. However the yellow recording head, the most upstream of the three, may be moved quickly to press the recording sheet 5. In the above, all the thermal heads are moved slowly in stopping application of pressure to the recording sheet 5. However the cyan recording head, the most downstream of the three, may be moved quickly in stopping application of pressure to the recording sheet 5. It is also possible to fix the cyan recording head 36 on the lever 40 without the head lifting spring.

Although the present invention has been fully described by way of the preferred embodiments thereof with reference to the accompanying drawings, various changes and modifications will be apparent to those having skill in this field. Therefore, unless otherwise these changes and modifications depart from the scope of the present invention, they should be construed as included therein.

What is claimed is:

1. A color thermal printer in which plural thermal heads are disposed along a transport path of recording material, said thermal heads are serially moved to an advanced position where said thermal heads are pressed against said recording material, and a full-color image is thermally recorded to said recording material by said thermal heads in said advanced position while said recording material is transported in one direction, said color thermal printer comprising:

plural head moving devices, respectively associated with said thermal heads in movable fashion between said advanced position and a retracted position substantially away from said recording material, for moving said thermal heads from said retracted position to said advanced position slowly during a predetermined advancing period, gradually to raise a pressing force of said thermal heads to said recording material, said thermal heads enabled at a lapse of said predetermined advancing period;

means for driving a first one of said thermal heads to record to said recording material; and means for controlling said plural head moving devices such that a second one of said thermal heads moves slowly to said advanced position during said predetermined advancing period, while said driving means drives said first thermal head to record, said second thermal head being disposed downstream from said first thermal head relative to said one direction of transporting said recording material.

2. A color thermal printer as defined in claim 1, wherein, after the recording material has passed a first one of said thermal heads, and while a second one of said thermal heads records to said recording material, said first thermal head, upstream from said second thermal head relative to said one direction of transporting said recording material, is moved to said retracted position slowly during said predetermined retracting period.

3. A color thermal printer as defined in claim 2, wherein each of said head moving devices includes:

a movable portion, disposed in movable fashion and close to a respective rear end of said thermal heads relative to a direction toward said recording material; and a cam portion projected from a periphery of said movable portion, said cam portion having a cam edge including first and second positions, said first position located closer to a path of movement of said movable portion, said second position located farthest from said movement path, said cam edge sloped from said first position toward said second position and adapted to moving respective said thermal heads.

4. A color thermal printer as defined in claim 3, wherein each of said head moving devices further includes a head lifting spring for biasing respective said thermal heads toward said retracted position, to move said thermal heads to said retracted position while said rear end of said thermal heads is guided by following said cam edge.

5. A color thermal printer as defined in claim 4, wherein said movable portion is cylindrical, and rotatable about a central axis thereof; and said first position of said cam portion has a smaller rotational radius about said central axis of said cylindrical portion, and said second position of said cam portion has a greatest rotational radius about said central axis of said cylindrical portion.

6. A color thermal printer as defined in claim 5, wherein each of said head moving devices further includes a transmission lever, disposed in swingable fashion, and having first and second ends, said first end contacted on said rear end of respective said thermal heads, and said second end contacted on said cam portion;

said cam portion rotated in a first direction to direct said second position to said second end, for pressing said first end against said rear end of respective said thermal heads toward said advanced position; and said cam portion rotated in a second direction to direct said first position to said second end, for rendering said first end free from said rear end of respective said thermal heads, while said head lifting spring moves respective said thermal heads to said retracted position.

7. A color thermal printer as defined in claim 5, further comprising a platen device, disposed to confront said thermal heads, for supporting said recording material.

8. A color thermal printer as defined in claim 7, wherein there are three of said thermal heads for recording of yellow, magenta and cyan colors, and three of said head moving devices.

9. A color thermal printer as defined in claim 7, further comprising plural pairs of transport rollers, disposed along said transport path, for nipping and transporting said recording material in said one direction; and said platen device including plural platen rollers, disposed between said plural pairs of said transport rollers and at intervals.

10. A color thermal printer as defined in claim 9, wherein said transport path is substantially straight.

11. A color thermal printer as defined in claim 9, wherein said transport path is curved.

12. A color thermal printer as defined in claim 7, wherein said platen device is a rotatable platen drum having a great diameter, of which said recording material is supported on a periphery, and which rotates said recording material in said one direction, said thermal heads disposed around said platen drum and at intervals.

13. A color thermal printer as defined in claim 1, wherein, after said thermal heads are driven in said advanced position, said plural head moving devices move said thermal heads from said advanced position to said retracted position slowly during a predetermined retracting period, gradually to lower said pressing force of said thermal heads to said recording material.

14. A color thermal printer in which plural thermal heads are disposed along a transport path of recording material, said thermal heads are serially moved to an advanced position where said thermal heads are pressed against said recording material, and a full-color image is thermally recorded to said recording material by said thermal heads in said advanced position while said recording material is transported in one direction, said color thermal printer comprising:

plural head moving devices, respectively associated with said thermal heads in movable fashion between said advanced position and a retracted position substantially away from said recording material, for moving said thermal heads from said advanced position to said retracted position slowly during a predetermined retracting period, gradually to lower a pressing force of said thermal heads to said recording material;

means for driving a first one of said thermal heads to record to said recording material; and means for controlling said plural head moving devices such that a second one of said thermal heads moves slowly to said advanced position during said predetermined advancing period, while said driving means drives said first thermal head to record, said second thermal head being disposed downstream from said first thermal head relative to said one direction of transporting said recording material.

15. A color thermal printer as defined in claim 14, further comprising:

plural platen rollers, disposed to confront respective said thermal heads, for supporting said recording material in fashion movable along said transport path and accessible from said thermal heads; and plural pairs of transport rollers, disposed along said transport path and beside said plural platen rollers, for transporting said recording material in said one direction.

16. A color thermal printer as defined in claim 15, wherein said transport path is substantially straight.

17. A color thermal printer as defined in claim 15, wherein said transport path is curved.

18. A color thermal printer as defined in claim 14, further comprising a rotatable platen drum having a great diameter, of which said recording material is supported on a periphery in fashion accessible from said thermal heads, said thermal heads disposed around said platen drum and at intervals, said platen drum rotated to rotate said recording material in said one direction along said transport path.

19. A color thermal printing method, in which plural thermal heads are disposed along a transport path of recording material, said thermal heads are serially moved to an advanced position where said thermal heads are pressed against said recording material, and a full-color image is thermally recorded to said recording material by said thermal heads in said advanced position while said recording material is transported in one direction, said color thermal printing method comprising steps of:

supporting respective said thermal heads in movable fashion between said advanced position and a retracted position substantially away from said recording material; and predetermining an advancing period preceding a time point when respective said thermal heads start being driven, said thermal heads moved from said retracted position to said advanced position slowly during said predetermined advancing period, gradually to raise a pressing force of said thermal heads to said recording material;

wherein, while a first one of said thermal heads records to said recording material, a second one of said thermal heads, downstream from said first thermal head relative to said one direction of transporting said recording material, is moved to said advanced position slowly during said predetermined advancing period.

20. A color thermal printing method as defined in claim 19, wherein plural pairs of transport rollers are disposed along said transport path, for transporting said recording material in said one direction; and plural platen rollers are disposed between said plural pairs of said transport rollers and at intervals, said thermal heads respectively disposed to confront said plural pairs of said platen rollers.

21. A color thermal printing method as defined in claim 20, wherein said transport path is substantially straight.

22. A color thermal printing method as defined in claim 20, wherein said transport path is curved.

23. A color thermal printing method as defined in claim 19, wherein a rotatable platen drum is disposed in rotatable fashion and has a great diameter, said recording material is supported on a periphery of said platen drum in fashion accessible from said thermal heads, said thermal heads disposed around said platen drum and at intervals, said platen drum rotated to rotate said recording material in said one direction along said transport path.

24. A color thermal printing method, in which plural thermal heads are disposed along a transport path of recording material, said thermal heads are serially moved to an advanced position where said thermal heads are pressed against said recording material, and a full-color image is thermally recorded to said recording material by said thermal heads in said advanced position while said recording material is transported in one direction, said color thermal printing method comprising steps of:

supporting respective said thermal heads in movable fashion between said advanced position and a retracted position substantially away from said recording material; and predetermining an advancing period preceding a time point when respective said thermal heads start being driven, said thermal heads moved from said retracted position to said advanced position slowly during said predetermined advancing period, gradually to raise a pressing force of said thermal heads to said recording material; and moving said thermal heads from said advanced position to said retracted position slowly during a predetermined retracting period, after said thermal heads are driven in said advanced position, gradually to lower said pressing force of said thermal heads to said recording material;

wherein, after the recording material has passed a first one of said thermal heads, and while a second one of said thermal heads records to said recording material, said first thermal head, upstream from said second thermal head relative to said one direction of transporting said recording material, is moved to said retracted position slowly during said predetermined retracting period.

* * * * *